US005498846A

United States Patent [19]

Chin

[11] Patent Number: 5,498,846

[45] Date of Patent: Mar. 12, 1996

[54] TOGGLE SWITCHES

[76] Inventor: Kun-San Chin, No. 200, Jung-Yu St., E. Dist., Tainan, Taiwan

[21] Appl. No.: 336,084

[22] Filed: Nov. 7, 1994

[51] Int. Cl.[6] ..... H01H 21/24

[52] U.S. Cl. ..... 200/557; 200/556; 200/553; 337/53

[58] Field of Search ..... 200/557, 553, 200/554, 555, 556, 558, 559, 560, 561, 562, 563, 339; 337/52, 53, 59

[56] References Cited

U.S. PATENT DOCUMENTS

| | | | |
|---|---|---|---|
| 2,053,629 | 9/1936 | Petersen | 337/52 |
| 3,106,622 | 10/1963 | Fleming | 200/557 |
| 3,225,156 | 12/1965 | Sahrbacker | 200/557 |

*Primary Examiner*—Henry J. Recla

*Assistant Examiner*—David J. Walczak

*Attorney, Agent, or Firm*—Varndell Legal Group

[57] ABSTRACT

A switch including two contact plates spaced in a housing, a bimetallic strip and a stop plate respectively connected to one contact plate, a T-shaped switch handle, a control block mounted around the switch handle, a conductive connecting plate fastened to a neck portion on the switch handle, a cushion mounted around the switch handle a first spring retained between the conductive connecting plate and the cushion, and a second spring supported between the control block and the head of the switch handle, wherein when the switch handle is turned sideways against the stop plate spring, the conductive connecting plate is forced to contact the first and second contact plates, causing the switch switched on; the bimetallic strip is deformed to force the stop plate spring away from switch handle, when the switch is overloaded, causing the switch to trip off.

3 Claims, 6 Drawing Sheets

TOGGLE SWITCHES

BACKGROUND OF THE INVENTION

The present invention relates to electric switches, and relates more particularly to such electric switches which automatically trip off when overloaded.

FIG. 1 shows a toggle switch according to the prior art, which is switched on when the switch handle is tiled leftwards or rightwards to force the connecting plate contact one side contact, and which is switched off when the switch handle is disposed in horizontal. This structure of toggle switch is not easy to assemble. The housing of the toggle switch is made in integrally. During the assembly process, the connecting plate must be installed in the housing before the installation of other component parts of the switching mechanism. Therefore, the switching mechanism of the toggle switch cannot be assembled into a unit and then fastened to the housing. Another drawback of this structure of is that the see-saw action of the connecting plate tends to cause a contact error if the connecting plate is not precisely installed or when an excessive pressured is applied to the switch handle. Still another drawback of this structure of a toggle switch is that it has no overload protection. Furthermore, this structure of toggle switch is not durable in use.

SUMMARY OF THE INVENTION

The present invention has been accomplished in view of the above circumstances. It is one object of the present invention to provide a toggle switch which automatically trips off when overloaded. It is another object of the present invention to provide a toggle switch which is easy to assemble. It is still another object of the present invention to provide a toggle switch which is durable in use.

According to one embodiment of the present invention, the toggle switch comprises two contact plates spaced in a housing, a bimetallic strip and a stop plate respectively connected to one contact plate, a T-shaped switch handle, a control block mounted around the switch handle, a conductive connecting plate fastened to a neck portion on the switch handle, a cushion mounted around the switch handle, a first spring retained between the conductive connecting plate and the cushion, and a second spring supported between the control block and the head of the switch handle, wherein when the switch handle is turned sideways against the stop plate spring, the conductive connecting plate is forced to contact the first and second contact plates, causing the switch to turn on. The bimetallic strip is deformed to force the stop plate spring away from switch handle, when the switch is overloaded, causing the switch to trip off. Because the conductive connecting plate is forced by springs, it does not displace when disposed in contact with the contact plates. Since the springs, the conductive connecting plate, the cushion, the control block, and the T-shaped switch handle can be assembled into one unit and then installed in the housing, the assembly process of the switch is easy.

DETAILED DESCRIPTION OF THE PREFERRED EMBODIMENTS

Figure 1:
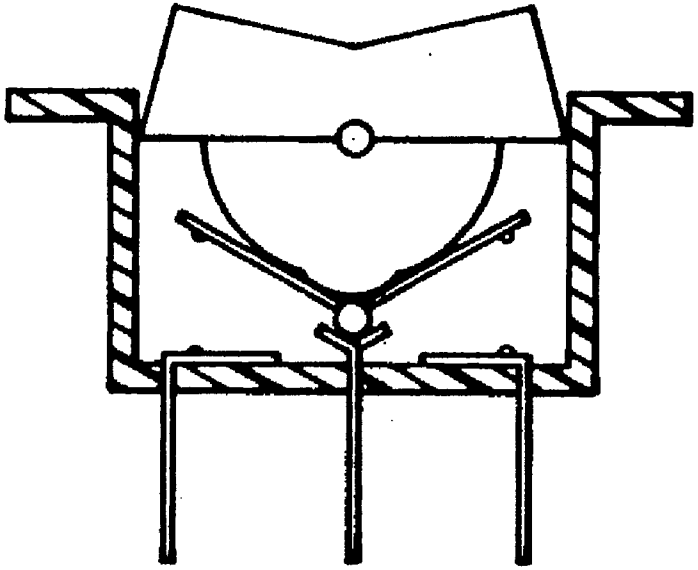
FIG-1 PRIOR ART
FIG. 1 is a sectional view of a toggle switch according to the prior art.
Figure 2:
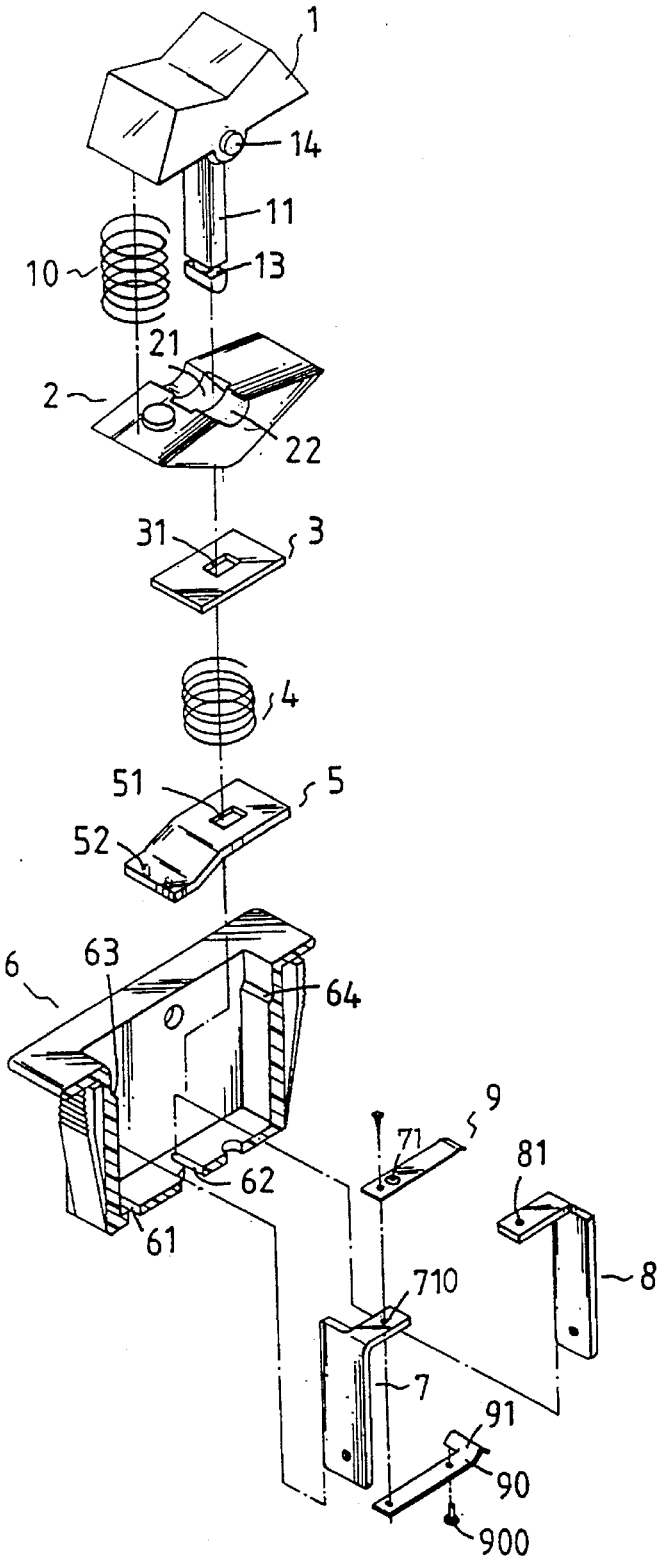
FIG. 2 is an exploded view of a toggle switch according to one embodiment of the present invention.
Figure 3:
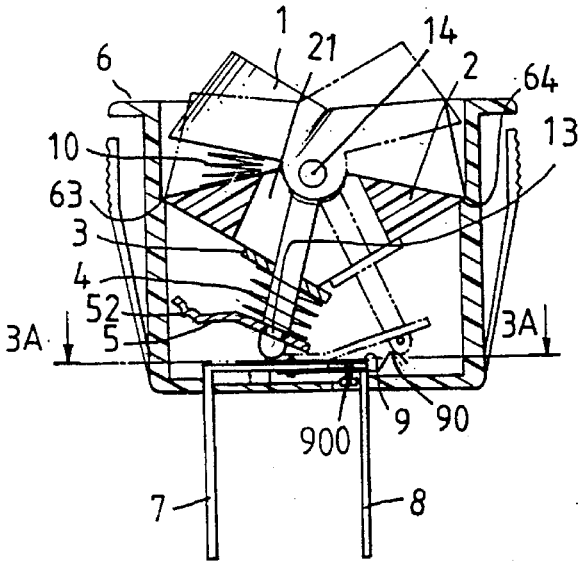
FIG. 3 is a schematic drawing, showing the switch handle of the toggle switch of FIG. 2 shifted.
Figure 3A:
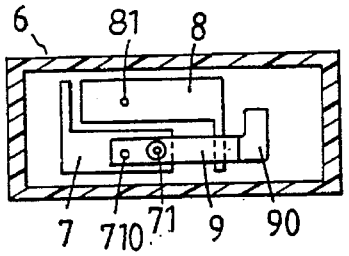
FIG. 3A is a bottom view in section of the toggle switch of FIG. 2.
Figure 4:
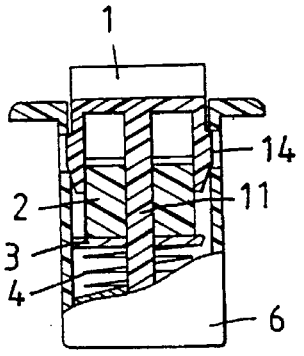
FIG. 4 is a side view in section of the toggle switch of FIG. 2.

Referring to FIGS. 2, 3, 3A, and 4, a toggle switch in accordance with the present invention is generally comprised of a switch handle 1, a V-shaped control block 2, a cushion 3, a first coil spring 4, a conductive connecting plate 5, a housing 6, a first contact plate 7, a second contact plate 8, a bimetallic strip 9, a stop plate spring 90, and a second coil spring 10. The switch handle 1 is made of substantially T-shaped configuration having a flat handle stem 11 inserted in proper order through a center through hole 21 on the V-shaped control block 2, a center through hole 31 on the cushion 3, the first coil spring 4, and a rectangular through hole 51 on the conductive connecting plate 5. After the handle stem 11 of the switch handle 1 has been inserted through the rectangular through hole 51 on the conductive connecting plate 5, the conductive connecting plate 5 is disposed around a neck portion 13 on the handle stem 11 and then turned through a certain angle (about 90 degree angle), and therefore the conductive connecting plate 5 is fastened to the handle stem 11 to hold the V-shaped control block 2, the cushion 3 and the first coil spring 4 in place. The second coil spring 10 is retained between the switch handle 1 and the V-shaped control block 2 at one side in parallel to the handle stem 11. The switch handle 1 further comprises two opposite pivot pins 14 supported in holes in the housing 6 adjacent a transverse groove 22 on the V-shaped control block 2 at two opposite sides by the center through hole 21 of the V-shaped control block 2. The first and second contact plates 7 and 8 are respectively inserted through two slots 61 and 62 on the bottom wall of the housing 6 with the respective contact portion 71 or 81 disposed inside the housing 6. The bimetallic strip 9 has one end riveted to a rivet point 710 on the first contact contact plate 7. The stop plate spring 90 has one end fastened to the first contact plate 7 at an opposite side relative to the bimetallic strip 9. The stop plate spring 90 is mounted with an adjusting screw 900 for adjusting the sensitivity of the bimetallic strip 9 relative to the stop plate spring 90. The switch handle 1 with the V-shaped control block 2, the cushion 3, the first coil spring 4 and the conductive connecting plate 5 are then inserted into the housing 6 permitting the V-shaped control block 2 to be supported on two opposite steps 63 and 64 on the inside wall of the housing 6. When installed, the contact portion 52 of the conductive connecting plate 5 is disposed corresponding to the contact portions 71 and 81 of the first and second contact plates 7 and 8.

Referring to FIG. 3 again, when the switch handle 1 is turned sideways to switch on the switch, the handle stem 11 is forced to abut the raised portion 91 on the free end of the stop plate spring 90, causing the contact portion 52 of the conductive connecting plate 5 to contact the contact portions 71 and 81 of the first and second contact plates 7 and 8, therefore the switch is switched on. When overloaded, the bimetallic strip 9 will be deformed to force the adjusting screw 900 downwards, causing the raised portion 91 of the stop plate spring 90 to release from the bottom end of the handle stem 11. When the handle stem 11 is released from the constraint of the raised portion 91 of the stop plate spring 90, the second coil spring 10 immediately pushes the switch handle 1 back to its former position, and therefore the switch is switched off.

Figure 5:
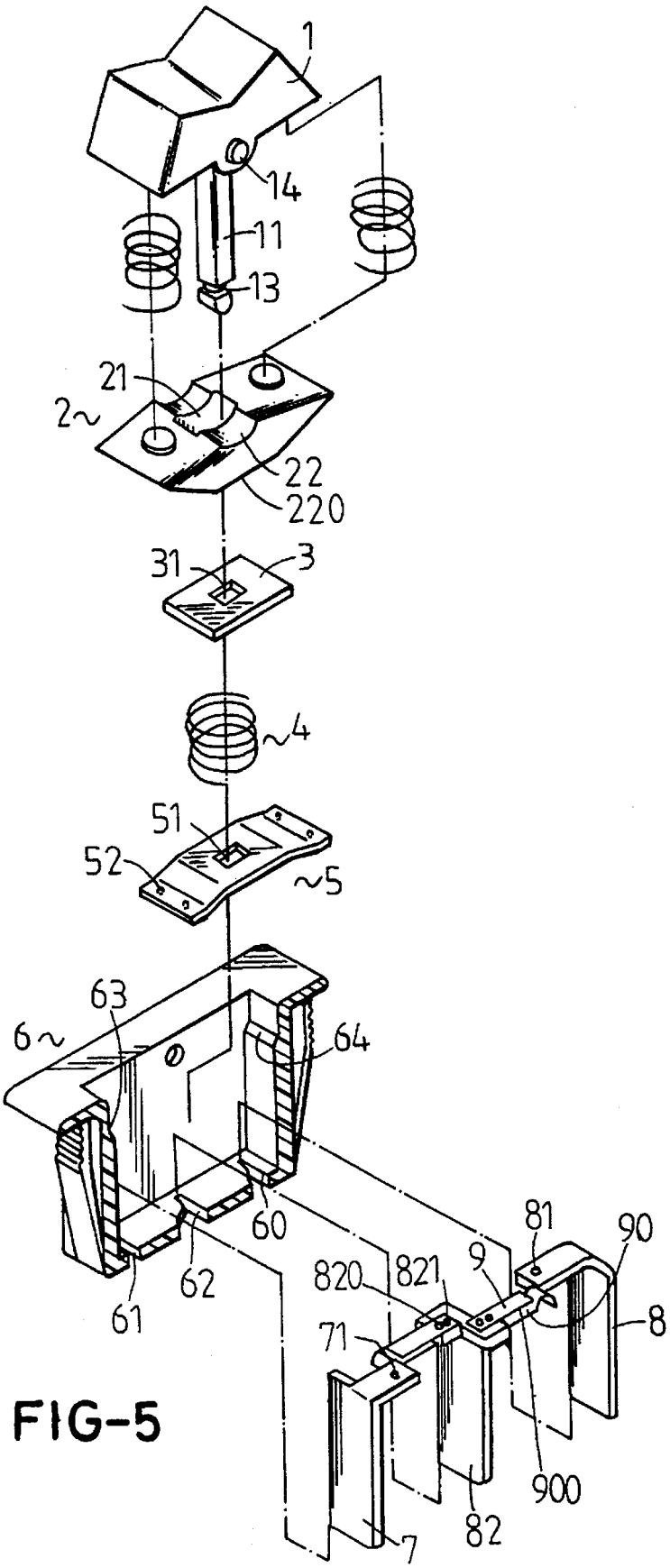
FIG. 5 is an exploded view of an alternate form of the present invention.
Figure 6A:
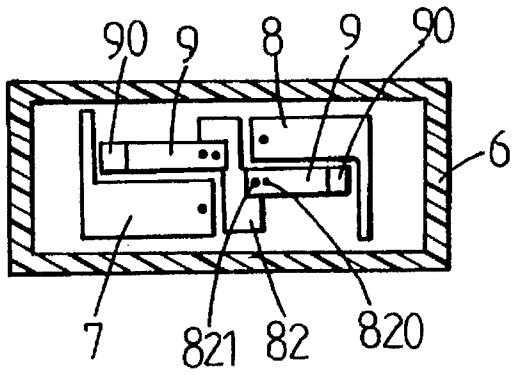
FIG. 6A is a sectional view taken along line 6A—6A of FIG. 6.
Figure 6:
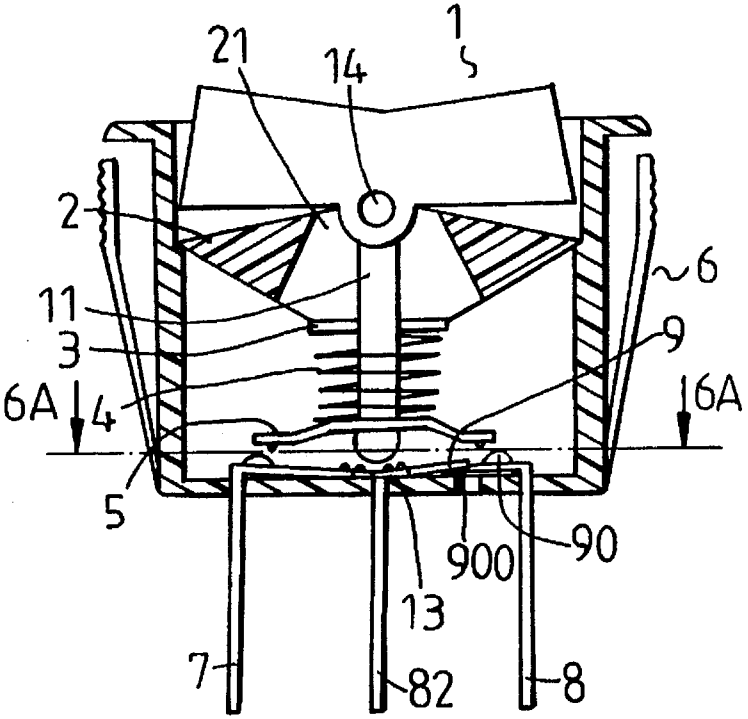
FIG. 6 is a sectional elevation of the toggle switch of FIG. 5, showing the handle stem disposed in the vertical position.

FIGS. 5, 6, and 6A show an alternate form of the present invention. According to this alternate form, the control block 2 has a flat bottom surface 220, which permits the switch handle 1 to be alternatively set in any of three positions. The conductive connecting plate 5 is made symmetrical. A third contact plate 82 is inserted through an additional slot 62 on the housing 6 and disposed between the first and second contact plates 7 and 8. Two bimetallic strips 9 and two spring plates 90 are provided having contact points 820 and rivet points 821 respectively connected to two opposite ends of the third contact plate 82. When the switch handle 1 is tilted leftwards, the first contact plate 7 and the third contact plate 82 are electrically connected; when the switch handle 1 tilted rightwards, the second contact plate 8 and the third contact plate 82 are electrically connected; when the switch handle 1 is disposed vertical, the third contact plate 82 is electrically disconnected from the first and second contact plates 7 and 8. If the switch is overloaded, the respective bimetallic strip 9 will be deformed, causing the switch handle 1 to trip off.

Figure 7A:
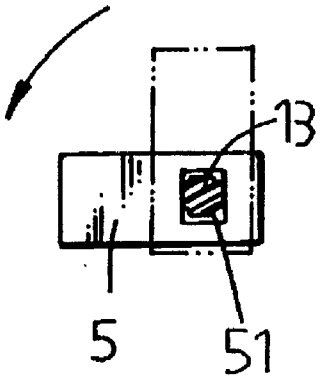
FIG. 7A is a section view taken along the line 7A—7A of FIG. 7.
Figure 7:
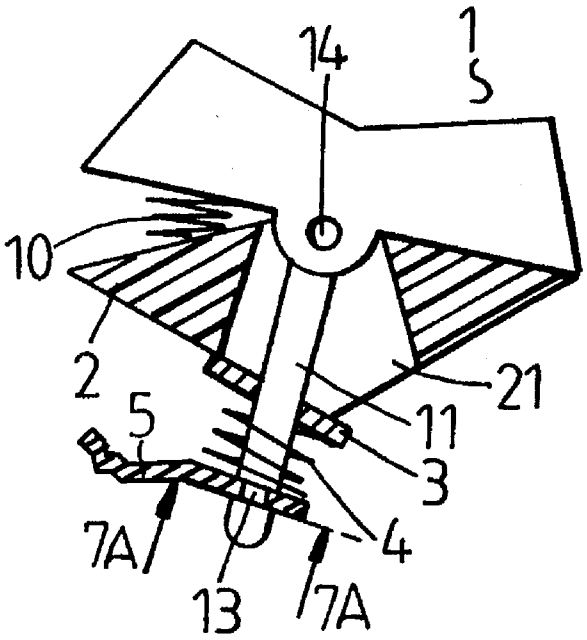
FIG. 7 is a sectional elevation of a handle stem shaped like a rectangular bar.

Referring to FIGS. 7 and 7A, the handle stem 11 is shaped like a rectangular bar, and the size of the rectangular through hole 51 on the conductive connecting plate 5 is approximately equal to the cross section of the handle stem 11. When the handle stem 11 is inserted in proper order through the through hole 21 on the control block 2, the through hole 31 on the cushion 3, the first coil spring 4, and the rectangular through hole 51 on the conductive connecting plate 5, the conductive connecting plate 5 is turned through certain angle, and therefore the conductive connecting plate 5 is retained to the neck portion 13 of the handle stem 11.

I claim:

1. A switch comprising:

a housing having a pair of opposing end walls, a pair of opposing side walls and a bottom wall, two slots disposed in said bottom wall, two transverse steps disposed on said respective opposing end walls and two aligned holes disposed in said respective side walls;

a first contact plate and a second contact plate respectively extending out of said housing through said slots, each contact plate having a respective top end disposed inside said housing;

a bimetallic strip having one end fixed to an upper surface of said top end of said first contact plate;

a stop plate spring having one end fixed to a lower surface of said top end of said first contact plate;

a substantially T-shaped switch handle having a head, and a stem extended from said head and suspended in said housing, said head having two pivot pins at two opposite sides thereof pivotally mounted in respective said aligned holes such that said handle is movable between first and second positions, said stem having a neck portion near a bottom end thereof;

a control block mounted around said stem and supported on said transverse steps, said control block having a transverse groove, which pivotally receives said handle;

a conductive connecting plate fastened to said neck portion of said stem;

a cushion mounted around said stem;

a first spring retained between said conductive connecting plate and said cushion; and a second spring supported between said control block and said head of said switch handle;

wherein when said switch handle is pivoted about said pivot pins from said first position to said second position, said handle stem is forced against said stop plate spring and said conductive connecting plate contacts said first and second contact plates and, when the switch is overloaded, said bimetallic strip is deformed to force said stop plate spring away from said handle stem, thereby permitting said switch handle to be forced by said second spring back to said first position wherein said conductive connecting plate is forced out of contact with said first and second contact plates.

2. A switch comprising:

a housing having a pair of opposing end walls, a pair of opposing side walls and a bottom wall, three slots disposed in said bottom wall, two transverse steps disposed on said respective opposing end walls and two aligned holes disposed on said respective side walls;

first, second and third contact plates respectively extending out of said housing through said slots, each contact plate having a respective top end disposed inside said housing, said third contact plate arranged between said first and second contact plates;

two bimetallic strips respectively having one end fixed to an upper surface of said top end of said third contact plate;

two stop plate springs respectively having one end fixed to a lower surface of said top end of said third contact plate below said bimetallic strips;

a substantially T-shaped switch handle having a head, and a stem extended from said head and suspended in said housing, said head having two pivot pins at two opposite sides thereof pivotally mounted in respective said aligned holes such that said handle is moveable between first, second and third positions, said stem having a neck portion near a bottom end thereof;

a control block mounted around said stem and supported on said transverse steps, said control block having a transverse top groove pivotally receiving said handle and a fiat bottom surface;

a conductive connecting plate fastened to said neck portion of said stem;

a cushion mounted around said stem and abutting said fiat bottom surface;

a first spring arranged about said stem and between said conductive connecting plate and said cushion at opposite sides of said stem; and second and third springs arranged between said control block and said head of said switch handle;

wherein when said switch handle is pivoted to said first position, said first and third contact plates are electrically connected by said conductive connecting plate; when said switch handle is pivoted to said second position, said first, second and third contact plates are electrically disconnected from said conductive connecting plate; when said switch handle is shifted to said third position, said second contact plate and said third contact plate are electrically connected; and when the switch is overloaded, a respective said bimetallic strip is deformed to force a respective said stop plate away from said handle, thereby permitting said switch handle to be forced by one of said second and third springs to said second position where said conductive plate is force out of contact with said first, second and third contact plates.

3. A switch comprising:

a housing having a pair of opposing end walls, a pair of opposing side walls and a bottom wall, two slots disposed in said bottom wall, two transverse steps disposed on said respective opposing end walls and two aligned holes disposed in said respective side walls;

a first contact plate and a second contact plate respectively extending out of said housing through said slots, each contact plate having a respective top end disposed inside said housing; in holes in the housing 6 adjacent a stop plate spring having one end fixed to a lower surface of said top end of said first contact plate;

a substantially T-shaped switch handle having a head, and a stem extended from said head and suspended in said housing, said head having two pivot pins at two opposite sides thereof pivotally mounted in respective said aligned holes such that said handle is movable between first and second positions, said stem having a neck portion near a bottom end thereof;

a control block mounted around said stem and supported on said transverse steps, said control block having a transverse groove, which pivotally receives said handle;

a conductive connecting plate fastened to said neck portion of said stem;

a first spring retained between said conductive connecting plate and said cushion; and a second spring supported between said control block and said head of said switch handle;

wherein when said handle is in said first position, said conductive connecting plate is out of contact with said first and second conductive plates; and when said switch handle is pivoted about said pivot pins from said first position to said second position, said handle stem is forced against said stop plate spring and said conductive connecting plate is forced to contact said first and second contact plates.

* * * * *